US009629432B2

(12) United States Patent
Edwards et al.

(10) Patent No.: US 9,629,432 B2
(45) Date of Patent: Apr. 25, 2017

(54) PORTABLE CONTAINER FOR A FOOD PRODUCT

(71) Applicant: WIKIFOODS, INC., Cambridge, MA (US)

(72) Inventors: David A. Edwards, Boston, MA (US); Laurent Robert Adrien Milon, Paris (FR)

(73) Assignee: WikiFoods, Inc., Cambridge, MA (US)

( * ) Notice: Subject to any disclaimer, the term of this patent is extended or adjusted under 35 U.S.C. 154(b) by 0 days.

(21) Appl. No.: 14/775,096

(22) PCT Filed: Mar. 7, 2014

(86) PCT No.: PCT/US2014/021745
§ 371 (c)(1),
(2) Date: Sep. 11, 2015

(87) PCT Pub. No.: WO2014/159056
PCT Pub. Date: Oct. 2, 2014

(65) Prior Publication Data

US 2016/0037886 A1 Feb. 11, 2016

Related U.S. Application Data

(60) Provisional application No. 61/780,193, filed on Mar. 13, 2013.

(51) Int. Cl.
*A45C 11/20* (2006.01)
*B65D 43/02* (2006.01)
(Continued)

(52) U.S. Cl.
CPC ..... *A45C 11/20* (2013.01); *A45C 13/02* (2013.01); *B65D 25/02* (2013.01); *B65D 43/02* (2013.01);
(Continued)

(58) Field of Classification Search
CPC ..... A45C 11/20; A45C 13/02; B65D 25/05; B65D 43/02; B65D 43/16; B65D 81/38; B65D 77/065
(Continued)

(56) References Cited

U.S. PATENT DOCUMENTS 2,321,703 A 6/1943 Rivard
2,545,127 A 2/1949 Wnuk
(Continued)

FOREIGN PATENT DOCUMENTS

WO 2011029009 A1 3/2011

OTHER PUBLICATIONS

International Preliminary Report on Patentability and Written Opinion dated Sep. 15, 2015 from corresponding PCT Application No. PCT/US2014/021745.
(Continued)

*Primary Examiner* — Chun Cheung
(74) *Attorney, Agent, or Firm* — McDermott Will & Emery LLP

(57) ABSTRACT

A portable food container includes a first container for receiving a food item and having a first end with an opening, a second end, and a sidewall connecting the first and second ends. A closure of the first container is releasably securable to the opening. A second container has an open configuration and a closed configuration, and defines a first cell for receiving a food item, a second cell for receiving the first container, and a port for receiving a portion of the first container. When the second container is in the closed configuration and the first container is located in the second cell, the first container opening is substantially aligned with the port to receive the closure. The closure secures the
(Continued)

second container in the closed configuration when the first container is located in the second cell and the closure is secured to the opening.

14 Claims, 7 Drawing Sheets

(51) Int. Cl.
*A45C 13/02* (2006.01)
*B65D 85/72* (2006.01)
*B65D 81/38* (2006.01)
*B65D 25/02* (2006.01)
*B65D 43/16* (2006.01)

(52) U.S. Cl.
CPC ..... *B65D 43/16* (2013.01); *B65D 81/38* (2013.01); *B65D 85/72* (2013.01); *A45C 2013/026* (2013.01)

(58) Field of Classification Search
USPC ..... 206/545, 541; 220/495.06
See application file for complete search history.

(56) References Cited

U.S. PATENT DOCUMENTS

| | | | | |
|---|---|---|---|---|
| 2,624,451 | A | 8/1949 | Ewing | |
| 2,611,476 | A | 8/1952 | Coney | |
| 2,707,550 | A | 5/1955 | Coney | |
| 3,026,995 | A | 8/1959 | Slaughter | |
| 3,072,285 | A | 1/1963 | Aileo | |
| D319,015 | S | 8/1991 | Schmidt | |
| D352,891 | S | 11/1994 | Lalique | |
| D371,736 | S | 7/1996 | Chahed | |
| D376,208 | S | 12/1996 | Rasmussen | |
| D386,673 | S | 11/1997 | Thompson | |
| 5,927,501 | A | 7/1999 | Herbruck | |
| 5,950,834 | A | 9/1999 | Woodnorth | |
| 5,996,427 | A * | 12/1999 | Masek | B01L 3/505 73/863.52 |
| 6,142,344 | A * | 11/2000 | Kai | B65D 75/5883 222/105 |
| 6,510,965 | B1 * | 1/2003 | Decottignies | B05B 11/0043 222/105 |
| D472,460 | S | 4/2003 | Garcia | |
| D472,774 | S | 4/2003 | Pelstring | |
| D476,895 | S | 7/2003 | Fellows | |
| D477,777 | S | 7/2003 | Nicolas | |
| D479,804 | S | 9/2003 | Wolpert | |
| 6,659,301 | B2 | 12/2003 | Fellows | |
| D490,082 | S | 5/2004 | Lenaerts | |
| D503,621 | S | 4/2005 | Heater | |
| D505,330 | S | 5/2005 | Wolpert | |
| D518,730 | S | 4/2006 | Caserta | |
| D536,979 | S | 2/2007 | Caserta | |
| D537,351 | S | 2/2007 | Caserta | |
| D577,292 | S | 9/2008 | Moretti | |
| D618,550 | S | 6/2010 | DeHaan | |
| D619,464 | S | 7/2010 | Langley | |
| D626,845 | S | 11/2010 | DeHaan | |
| D642,923 | S | 8/2011 | Newton | |
| D643,296 | S | 8/2011 | Newton | |
| D650,683 | S | 12/2011 | Buschmann | |
| 8,328,034 | B2 | 12/2012 | Miros | |
| 8,646,679 | B2 * | 2/2014 | Hill | B65D 5/46112 229/117.15 |
| 2005/0194344 | A1 | 9/2005 | Heater | |
| 2008/0314788 | A1 | 12/2008 | Adams | |
| 2011/0114526 | A1 | 5/2011 | Neumann | |
| 2011/0220652 | A1 * | 9/2011 | Corbett | B65D 77/06 220/495.03 |
| 2012/0248117 | A1 * | 10/2012 | Corbett | B65D 23/102 220/495.06 |

OTHER PUBLICATIONS

International Search Report and the Written Opinion dated Jun. 24, 2014 from corresponding PCT Application No. PCT/US2014/021745.

* cited by examiner

PORTABLE CONTAINER FOR A FOOD PRODUCT

RELATED APPLICATIONS

This application is the U.S. National Stage of International Application No. PCT/US2014/021745, filed Mar. 7, 2014, published in English, and claims the benefit of U.S. Provisional Application No. 61/780,193, filed Mar. 13, 2013, the entirety of which is incorporated herein by reference.

FIELD OF THE DISCLOSURE

The present disclosure relates generally to a portable container for a food product and, more particularly, to a portable food container including a first container received by a second container where the contents of the first container can be accessed regardless of whether the second container is opened or closed, and where a closure of the first container secures the second container in a closed configuration. The disclosure finds particularly useful application when the food product is an approximately spherical food product comprised of an edible center portion surrounded by an edible and/or biodegradable coating that functions as a protective storage and transportation membrane for the food product.

BACKGROUND OF THE DISCLOSURE

Specialized containers are known for all manner of food products. Containers, such as egg cartons, may include specialized areas or compartments that are shaped in a manner that is complimentary to the food product. Other containers, such as lunch boxes, may be more generic in form, which enables them to carry a wide variety of food items. Some containers, lunch boxes again being one example, include provisions for carrying other containers. This configuration allows for a first type of food product, such as a liquid, to be placed in an inner container, and for the inner container and other types of food products to be carried together within the outer container. Accessing the contents of the inner container typically requires removing the inner container from the outer container.

SUMMARY OF THE DISCLOSURE

The present disclosure relates to a portable container configured to overcome these and other prior deficiencies and to provide a portable food container that permits access to the contents of a first container that is positioned within a second container, and where a closure of the first container secures the second container in a closed configuration.

In one embodiment, the present disclosure provides a portable food container including a first container and a second container. The first container is configured to receive an edible or potable substance and includes a first end having an opening, a second end opposed to the first end, and a sidewall disposed about and connecting the first end and second end. A closure of the first container is releasably securable to the opening. The second container has an open configuration and a closed configuration. The second container defines a first cell configured to receive an edible or potable substance, a second cell configured to receive the first container, and a port configured to receive a portion of the first container. When the second container is in the open configuration, the first container is removably locatable in the second cell. When the second container is in the closed configuration and the first container is located in the second cell, the first container opening is substantially aligned with the port to receive the closure.

In some embodiments, the second container may include a base and a lid pivotally coupled to the base by a hinge for movement between the open configuration and the closed configuration. The second cell may define a second cell axis, and the hinge may define a hinge axis. In one embodiment the hinge axis is substantially perpendicular to the second cell axis. In another embodiment, the hinge axis is substantially parallel to the second cell axis. A top surface of the lid may define a semi-cylindrical projection defining an axis that extends substantially perpendicular to a plane defined by the port. The semi-cylindrical projection may correspond to a semi-cylindrical recess on an inner surface of the lid, and the semi-cylindrical recess may be configured to receive the first container. The second container may define a neck substantially surrounding and extending at least one of inwardly and outwardly with respect to the port. The portion of the first container received by the port may include a portion of the closure. At least one of the first end and the closure may extend through the port when the opening receives the closure.

In other embodiments, the second container may include a base and a lid, and the port may be defined in part by the base and in part by the lid. The port may include a substantially circular perimeter, and the base may define less than half of the perimeter. The closure may secure the first container in the second cell when the second container is in the closed configuration and the closure is secured to the opening. The closure may secure the second container in the closed configuration when the first container is located in the second cell and the closure is secured to the opening. When the first container is located in the second cell, the first container may divide the second container into opposed first and second food product areas, and each food product area may include a plurality of the first cells. The first container may be substantially cylindrical. The first container may be thermally insulated. The first container may be substantially leak-proof when the closure is secured to the opening.

In another embodiment, the present disclosure relates to a portable food container including a first container that is configured to receive an edible or potable substance, and a second container. The first container includes a first end having an opening, a second end opposed to the first end, a sidewall disposed about and connecting the first end and second end, and a closure releasably securable to the opening. The second container has an open configuration and a closed configuration, and includes a base and a lid pivotally connected to the base for movement between the open configuration and the closed configuration. The base defines a first cell configured to receive an edible or potable substance, and a second cell configured to receive the first container. The closure secures the second container in the closed configuration when the first container is located in the second cell and the closure is secured to the opening.

In some embodiments, the when the second container is in the closed configuration and the first container is located in the second cell, the first container opening may be substantially aligned with the port to receive the closure. The second container may define a neck substantially surrounding the port, and the closure may engage the neck to secure the second container in the closed configuration. The neck may include a first portion defined by the lid and a second portion defined by the base. The first and second portions of the neck may define a substantially circular perimeter of the port, and the second portion of the neck may define less than half of the perimeter.

DETAILED DESCRIPTION OF THE PREFERRED EMBODIMENTS

Figure 1:
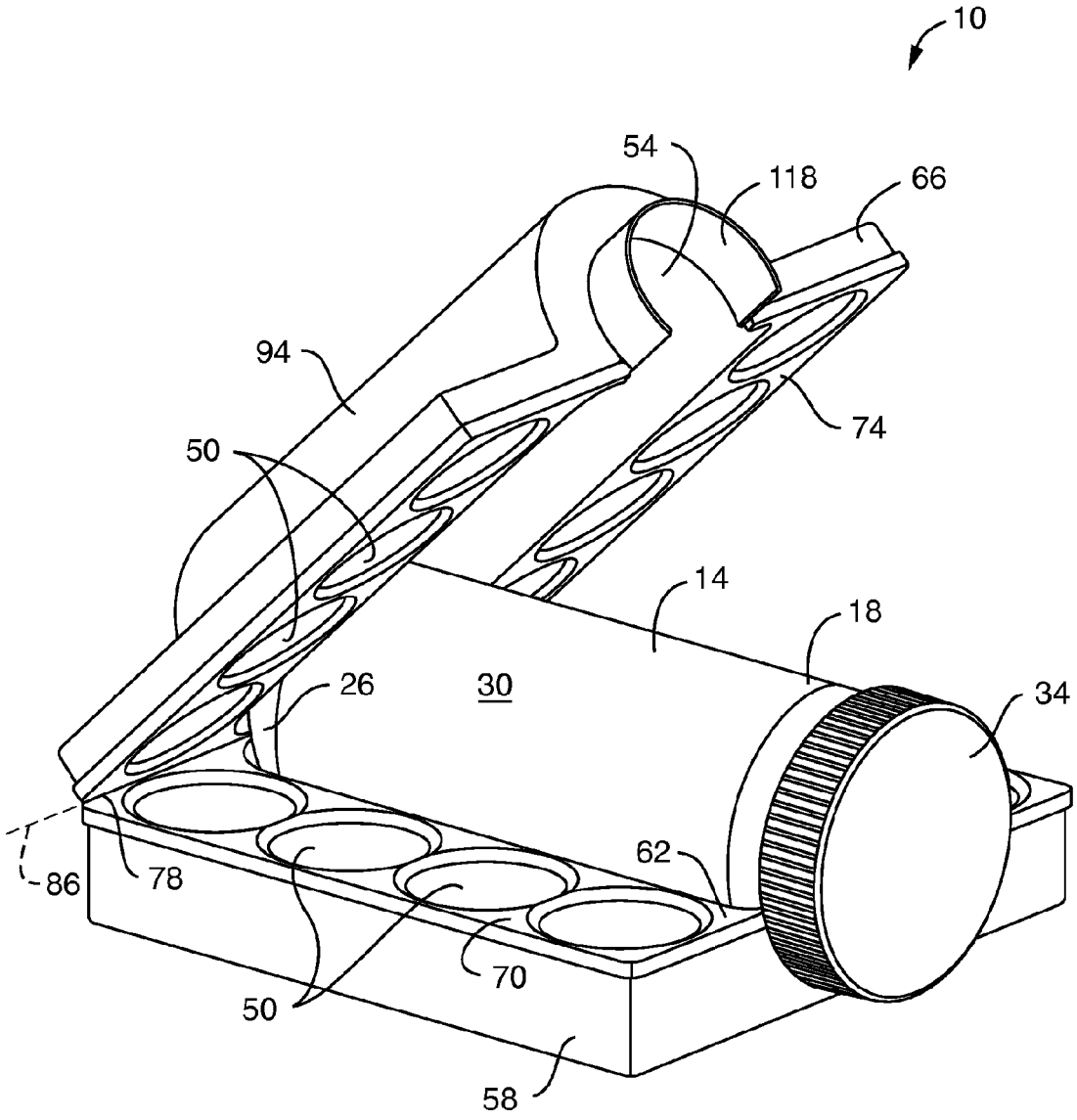
FIG. 1 is a perspective view of a portable food container according to one exemplary embodiment in a partially open configuration.

FIGS. 1-9 illustrate a portable food container 10 for the storage and transportation of a substantially spherical food item 12 (FIG. 2) in the form of an edible or potable substance encased in an edible polymer matrix, as described, for example, in PCT International Publication No. WO 2011/103594 and in PCT International Application No. PCT/US2013/023500, which are both incorporated herein by reference in their entirety. The portable food container 10 includes a generally cylindrical first container 14 including a first end 18 having an opening 22 (FIG. 3), a second end 26 opposite the first end 18, and a sidewall 30 disposed about and connecting the first end 18 and the second end 26. The first container 14 also includes a closure 34 that is releasably securable to the opening 22. In the illustrated embodiment, the closure 34 includes a generally cylindrical cap portion 38 having a diameter greater than the opening 22, and an insert portion 42 having a diameter less than the opening 22. In the illustrated embodiment, the insert portion 42 is formed of a deformable polymer and is configured for a snug friction fit within the opening 22. Other embodiments may include an insert portion 42 that threads into the opening 22 or that is secured to the opening in other ways. These and other configurations may provide a substantially leak-proof connection between the closure 34 and the opening 22. The opening 22 is sized to receive a first food item 12 such that a plurality of first food items 12 can be stored in the interior of the first container 14. The first container 14 may be insulated to maintain the first food items 12 stored within the first container 14 at a temperature that is elevated or reduced with respect to ambient.

Figure 2:
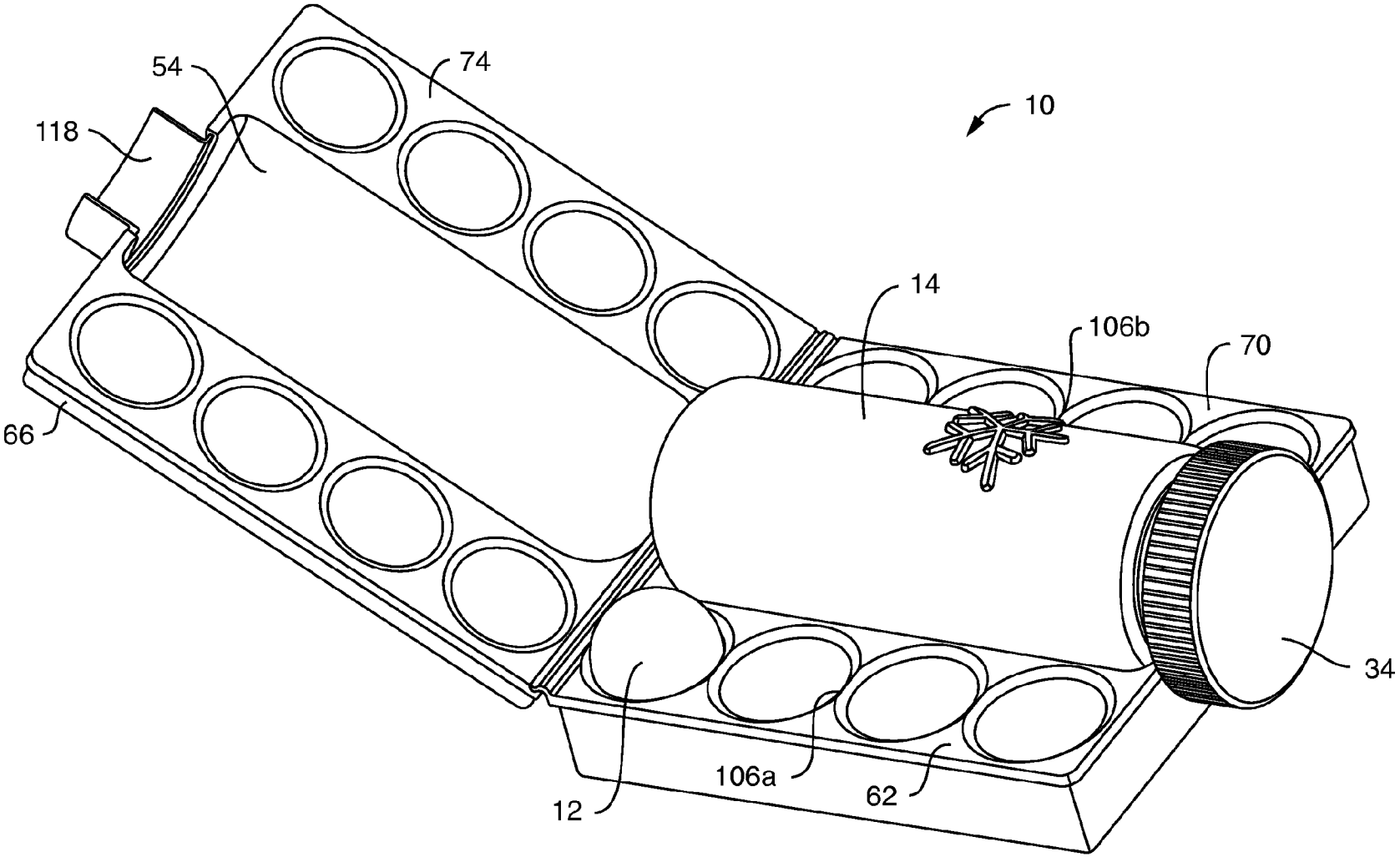
FIG. 2 is a perspective view of the portable food container of FIG. 1 in a fully open configuration.
Figure 3:
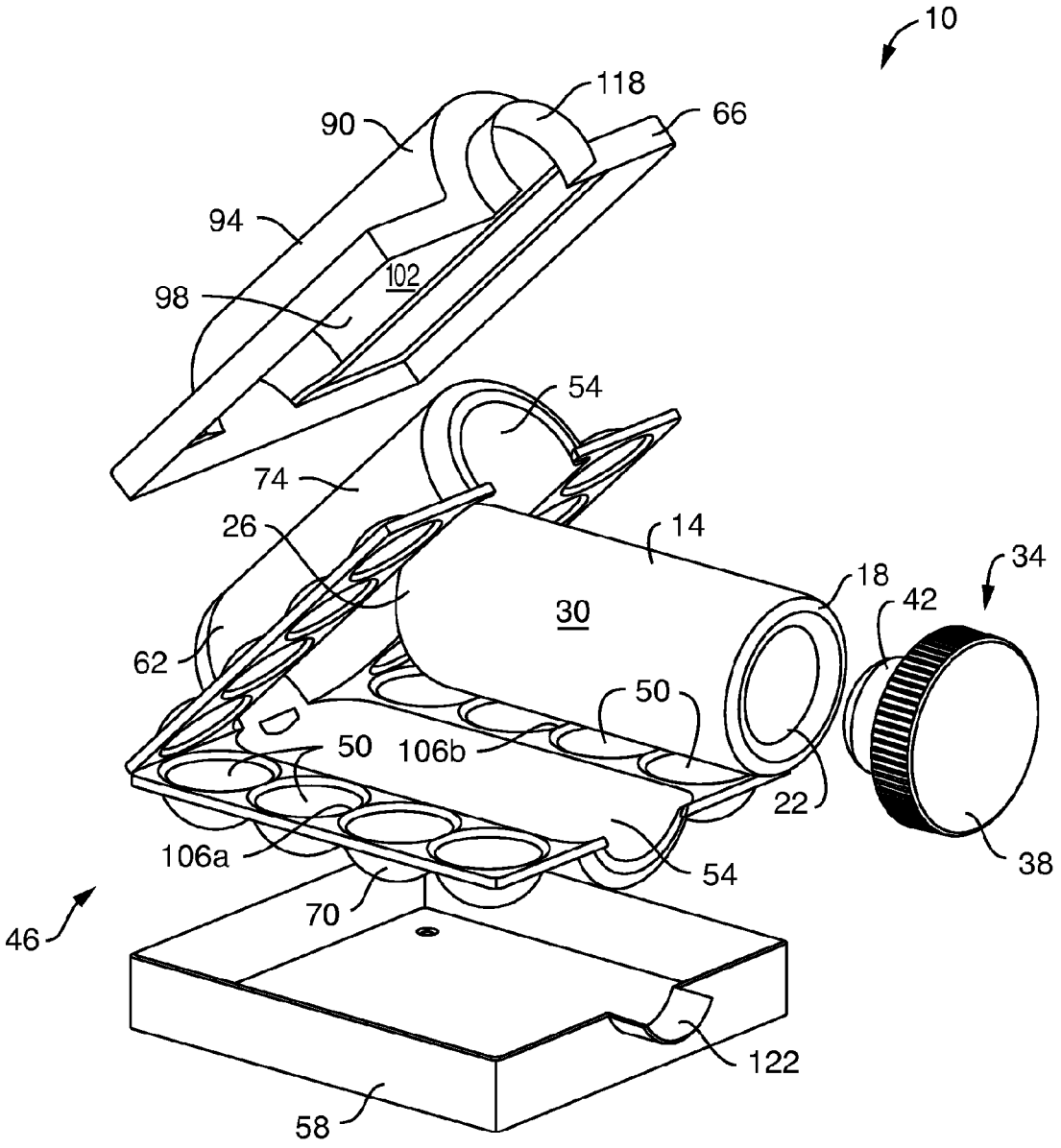
FIG. 3 is an exploded perspective view of the portable food container of FIG. 1.

The portable food container 10 also includes a second container 46 that is configured to receive the first container 14 and a second food item. The second container 46 has an open configuration (FIG. 2) and a closed configuration (FIGS. 5-9). As shown in FIGS. 1 and 2, the second container includes a plurality of first cells 50 each configured to receive a respective second food item 12, and a second cell 54 (FIG. 3) configured to receive the first container 14. When the second container 46 is in the open configuration, the first container 14 is removably locatable in the second cell 54. The second container 46 includes a base 58, an insert member 62 received by the base, and a lid 66 pivotally coupled to the base 58. The base 58 and the lid 66 may be or include a relatively durable and substantially rigid material, such as aluminum or a suitable plastic. The insert member 62 may be or include a durable yet flexible material, such as molded silicone.

In the illustrated configuration, the insert member 62 includes a lower portion 70 that is received by the base 58, and an upper portion 74 that is received by the lid 66. A hinge mechanism, for example a living hinge 78, is provided between the upper portion 74 and the lower portion 70 of the insert member 62, and functions to pivotally couple the lid 66 to the base 58 for movement between the open configuration and the closed configuration. The upper and lower portions 74, 70 of the insert member cooperatively define the plurality of first cells 50 and the second cell 54. For the first cells 50, substantially half of each cell 50 is defined by the upper portion 74, and the other half of each cell 50 is defined by the lower portion 70. The second cell 54 however is upwardly offset such that the upper portion 74 defines more than half of the second cell 54 and the lower portion 70 defines less than half of the second cell 54. In the illustrated configuration, a longitudinal axis of the second cell 54 is substantially perpendicular to a hinge axis 86 defined by the living hinge 78. In other embodiments the living hinge 78 may be moved from the rear of the container 10 to one of the sides of the container 10 such that the hinge axis 86 is substantially parallel to the longitudinal axis of the second cell 54. In still other embodiments, the insert member 62, including the lower portion 70 and upper portion 74 of the insert member 62, may be formed as part of the base 58 and lid 66, respectively, including being integrally formed (e.g., molded) therewith. In such configurations the combined base 58 and lower portion 70 may be pivotally coupled with the combined lid 66 and upper portion 74 by a living hinge or by a separate hinge assembly.

The lid 66 includes a top surface 90 that defines a semi-cylindrical projection 94. The projection 94 on the top surface 90 corresponds to a semi-cylindrical recess 98 formed on an inner surface 102 of the lid 66 and configured to receive the first container 14. More specifically, the semi-cylindrical recess 98 receives the upper portion 74 of the insert member 62 that defines the second cell 54. As best shown in FIG. 2, when the first container 14 is located in the second cell 54, the first container 14 divides the second container into opposite first and second food product areas 106*a*, 106*b*, with each food product area 106*a*, 106*b* including a plurality of first cells 50.

When the second container 46 is closed and the first container 14 is located in the second cell 54, the sidewall 30 of the first container 14 separates the first food stuff in the first container 14 from the second food stuff.

Figure 4:
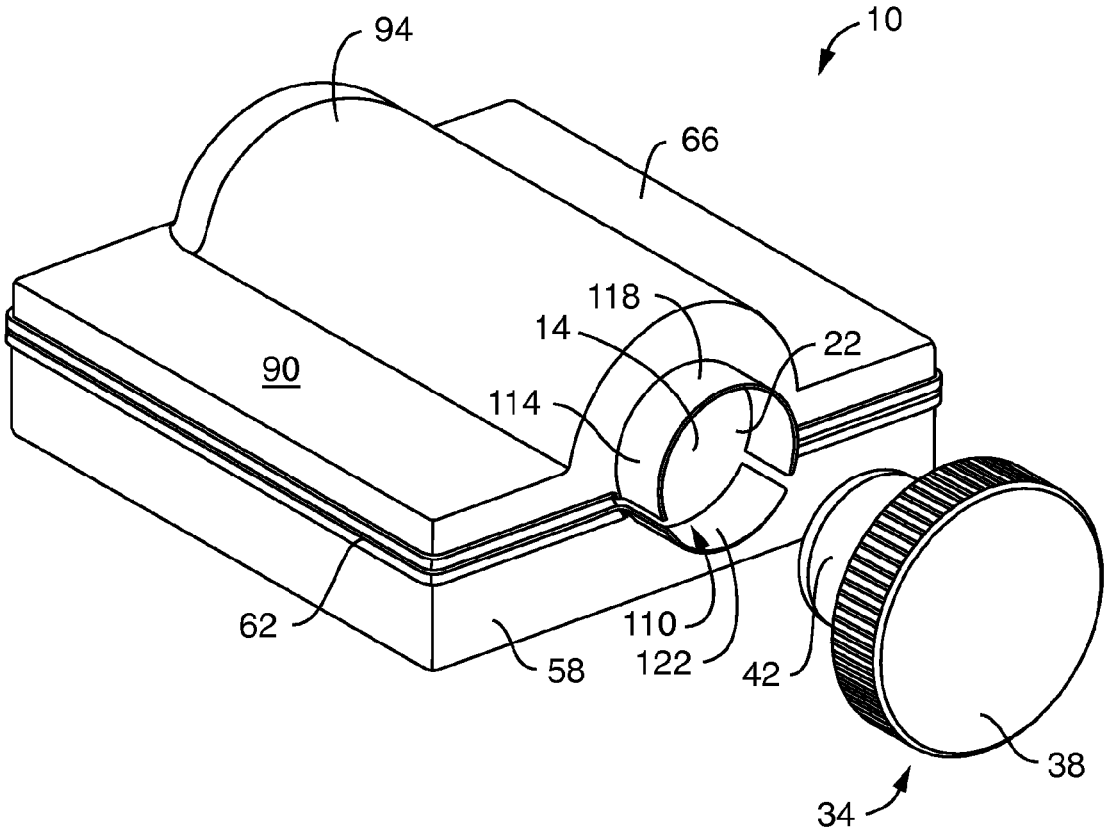
FIG. 4 is a partially exploded perspective view of the portable food container of FIG. 1 in a closed configuration showing a closure removed from the container.
Figure 5:
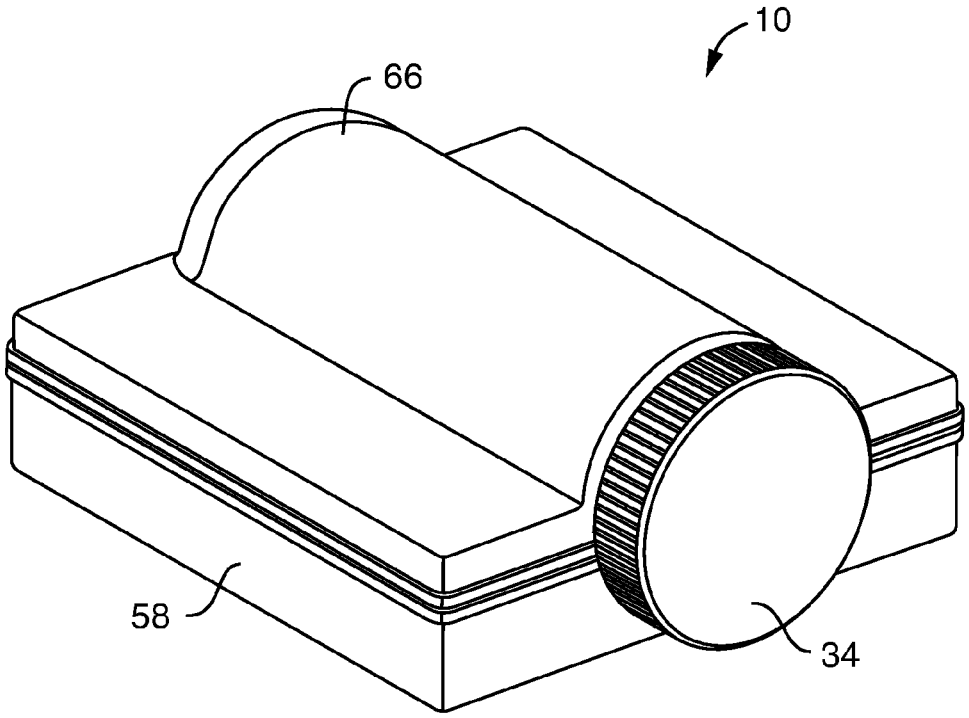
FIG. 5 is a perspective view of the portable food container of FIG. 1 in a closed configuration.
Figure 6:
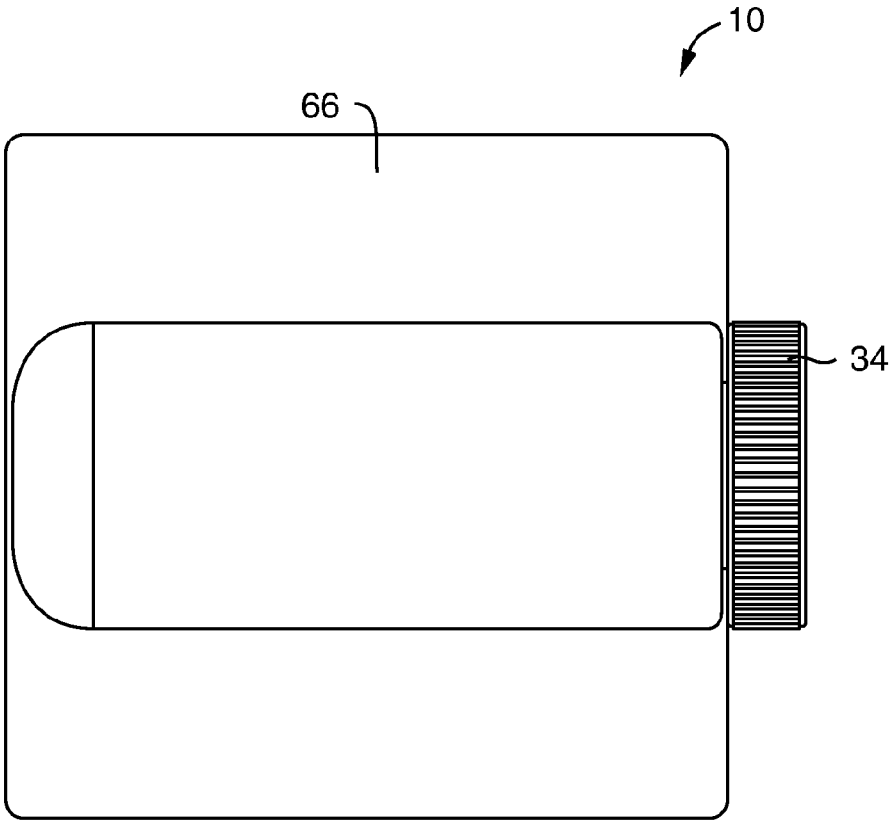
FIG. 6 is a top view of the portable food container of FIG. 1 in the closed configuration.
Figure 7:
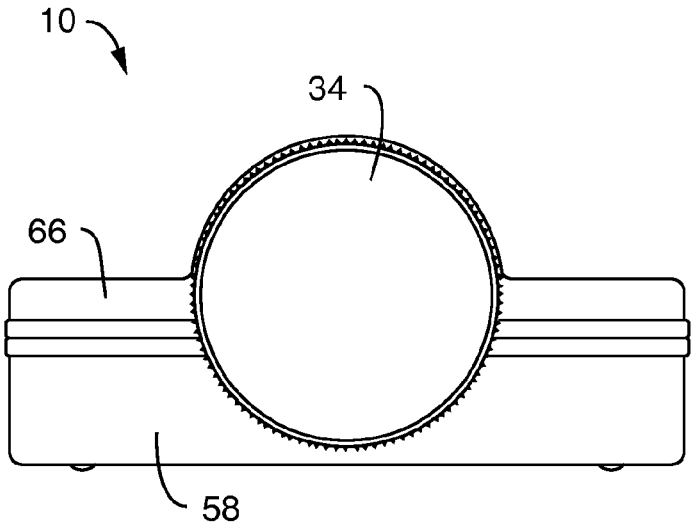
FIG. 7 is a front view of the portable food container of FIG. 1 in the closed configuration.
Figure 8:
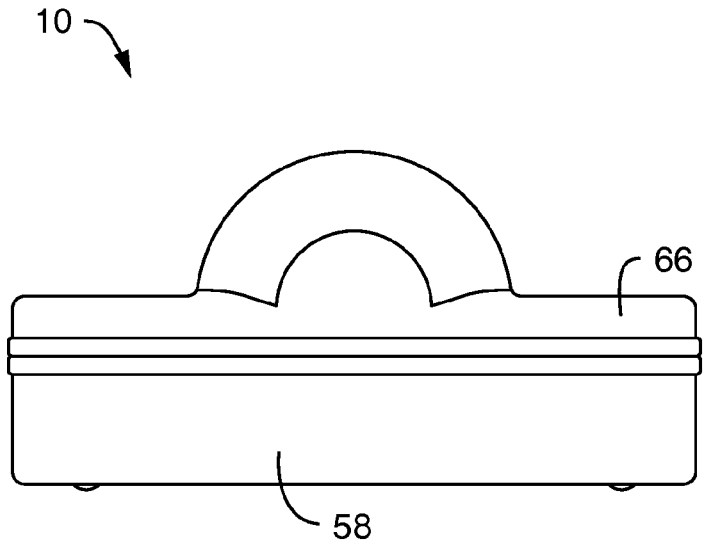
FIG. 8 is a rear view of the portable food container of FIG. 1 in the closed configuration.
Figure 9:
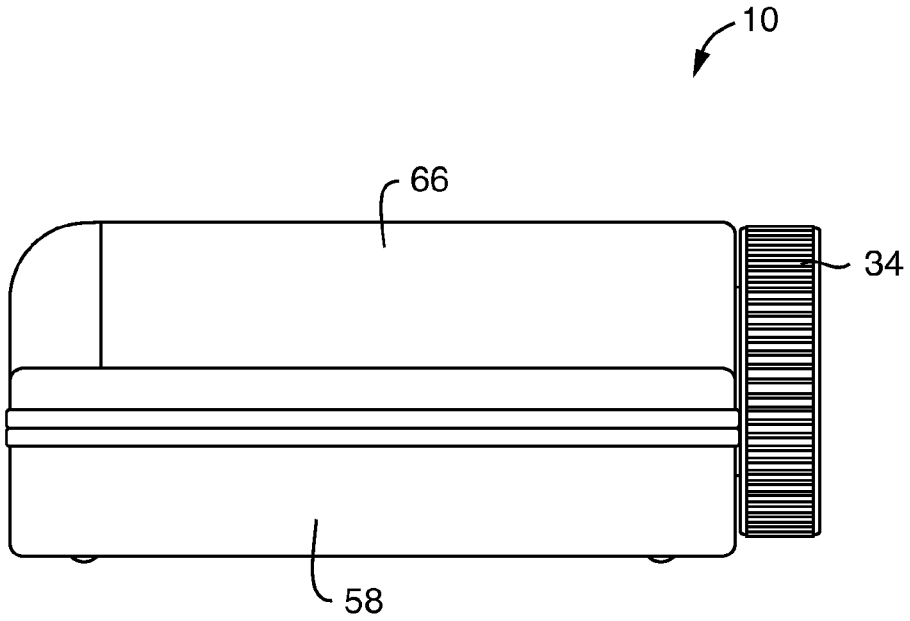
FIG. 9 is a side view of the portable food container of FIG. 1 in the closed configuration.

As best shown in FIG. 4, the lid 66 and the base 58 cooperate to define a substantially circular port 110 that communicates with the interior of the container 10. The port 110 is configured such that when the first container 14 is positioned in the second cell 54 and the second container 46 is in the closed configuration, the first container opening 22 is substantially aligned with the port 110. Alignment of the first container opening 22 and the port 110 allows the closure 34 to be inserted through the port 110 and into the opening 22. More specifically, in the illustrated configuration, the insert portion 42 of the closure 34 can be extended through the port 110 and into the opening 22 while the second container 46 is in the closed position. In other configurations, the first container 14 may include a projection that extends through the port 110 for engagement with the closure 34 at a location outside of the second container. In still other configurations, portions of both the first container 14 and the closure 34 may extend through the port 110 for engagement with one another. Each of the foregoing configurations allows the closure 34 to be removed and the first food product 12 extracted from the first container 14 without opening the second container 46 and without removing the first container 14 from the second container 46. Because the second cell 54 is upwardly offset as discussed above, the base 58 defines less than half of the circular perimeter of the port 110 and the lid 66 defines more than half of circular perimeter of the port 110.

In the illustrated embodiment, the second container 46 includes a neck 114 that defines and surrounds the port 110. The illustrated neck 114 extends outwardly with respect to the port 110. In other embodiments the neck 114 may also or alternatively extend inwardly with respect to the port 110. The neck 114 includes an upper neck portion 118 defined by the lid 66 and a lower neck portion 122 defined by the base 58. When the first container 14 is in the second cell 54 and the second container 46 is in the closed configuration, inserting the closure 34 through the port 110 and into the opening 18 of the first container 14 secures the first container 14 within the second cell 54 and also secures the second container 46 in the closed configuration. More specifically, as the insert portion 42 of the closure 34 is inserted through the port 110 and into the opening 18, the cap portion 38 of the closure 34 moves into surrounding engagement with the neck 114 and secures the upper neck portion 118 and the lower neck portion 122 in the adjacent relationship shown in FIG. 4 and associated with the closed configuration of the second container 46. Engagement of the cap portion 38 with the neck 114 prevents separation of the upper and lower neck portions 118, 122, thereby securing the second container 46 in the closed configuration.

While the disclosure makes reference to the details of preferred embodiments of the disclosure, it is to be understood that the disclosure is intended in an illustrative rather than in a limiting sense, as it is contemplated that modifications will readily occur to those skilled in the art, within the spirit of the disclosure and the scope of the appended claims.

We claim:

1. A portable food container, comprising:

a first container, containing a first edible or potable substance, the first container including:

a first end having an opening, a second end opposed to the first end, a sidewall disposed about and connecting the first end and second end, and a closure releasably securable to the opening; and a second container comprising a base and a lid pivotally coupled to the base facilitating second container open configuration and a second container closed configuration, the second container defining:

a first cell containing a second edible or potable substance, a second cell configured to removably receive the first container, and a port configured to receive a portion of the first container, wherein the second container defines a neck substantially surrounding the port and comprised of an upper neck portion and a lower neck portion extending at least one of inwardly and outwardly with respect to the port, and when the second container is in the open configuration, the first container is removably locatable in the second cell, and when the second container is in the closed configuration and the first container is located in the second cell, the first container opening is substantially aligned with the port to receive the closure, and the closure is in surrounding engagement with the neck and secures the upper neck portion and the lower neck portion in an adjacent relationship securing the first container in the second cell, and the sidewall of the first container is configured to separate the first edible or potable substance from the second edible or potable substance.

2. The portable food container of claim 1, wherein the base and the lid are pivotally coupled by a hinge for movement between the open configuration and the closed configuration.

3. The portable food container of claim 2, wherein the second cell defines a second cell axis, and wherein the hinge defines a hinge axis that is substantially perpendicular to the second cell axis.

4. The portable food container of claim 2, wherein the second cell defines a second cell axis, and wherein the hinge defines a hinge axis that is substantially parallel to the second cell axis.

5. The portable food container of claim 2, wherein a top surface of the lid defines a semi-cylindrical projection defining an axis that extends substantially perpendicular to a plane defined by the port.

6. The portable food container of claim 5, wherein the semi-cylindrical projection corresponds to a semi-cylindrical recess on an inner surface of the lid, and wherein the semi-cylindrical recess is configured to receive the first container.

7. A portable food container, comprising:

a first container, containing a first edible or potable substance, the first container including:

a first end having an opening, a second end opposed to the first end, a sidewall disposed about and connecting the first end and second end, and a closure releasably securable to the opening; and a second container comprising a base having a lower neck portion and a lid having an upper neck portion, the second container having an open configuration and a closed configuration, the second container defining:

a first cell containing a second edible or potable substance, a second cell configured to receive the first container, and a port configured to receive a portion of the first container, wherein when the second container is in the open configuration, the first container is removably locatable in the second cell, when the second container is in the closed configuration and the first container is located in the second cell, the first container opening is substantially aligned with the port to receive the closure and the sidewall of the first container is configured to separate the first edible or potable substance from the second edible or potable substance, and the closure is in surrounding engagement with the upper neck portion and the lower neck portion and secures the upper neck portion and the lower neck portion in an adjacent relationship, the portion of the first container received by the port includes a portion of the closure.

8. The portable food container of claim 1, wherein at least one of the first end and the closure extends through the port when the opening receives the closure.

9. A portable food container, comprising:

a first container, containing a first edible or potable substance, the first container including:

a first end having an opening, a second end opposed to the first end, a sidewall disposed about and connecting the first end and second end, and a closure releasably securable to the opening; and a second container comprising a base having a lower neck portion and a lid having an upper neck portion, the second container having an open configuration and a closed configuration, the second container defining:

a first cell containing a second edible or potable substance, a second cell configured to receive the first container, and a port defined by the lower neck portion and the upper neck portion and configured to receive a portion of the first container, wherein when the second container is in the open configuration, the first container is removably locatable in the second cell, when the second container is in the closed configuration and the first container is located in the second cell, the first container opening is substantially aligned with the port to receive the closure, the closure is in surrounding engagement with the upper neck portion and the lower neck portion securing the upper neck portion and the lower neck portion in an adjacent relationship, and the sidewall of the first container is configured to separate the first edible or potable substance from the second edible or potable substance.

10. The portable food container of claim 9, wherein the port includes a substantially circular perimeter, and wherein the base defines less than half of the perimeter.

11. A portable food container, comprising:

a first container, containing a first edible or potable substance, the first container including:

a first end having an opening, a second end opposed to the first end, a sidewall disposed about and connecting the first end and second end, and a closure releasably securable to the opening; and a second container comprised of a base and a lid, the second container having an open configuration and a closed configuration, the second container defining:

a first cell containing a second edible or potable substance, a second cell configured to receive the first container, and a port defined by a lower neck portion extending from the base and the upper neck portion extending from the lid, the port configured to receive a portion of the first container, wherein when the second container is in the open configuration, the first container is removably locatable in the second cell, when the second container is in the closed configuration and the first container is located in the second cell, the first container opening is substantially aligned with the port to receive the closure and the sidewall of the first container is configured to separate the first edible or potable substance from the second edible or potable substance, and the closure secures the second container in the closed configuration by surrounding the lower neck portion and the upper neck portion and securing the lower neck portion and the upper neck portion in an adjacent relationship when the first container is located in the second cell and the closure is secured to the opening.

12. The portable food container of claim 1, wherein the first container is substantially cylindrical.

13. The portable food container of claim 1, wherein the first container is thermally insulated.

14. The portable food container of claim 1, wherein the first container is substantially leak-proof when the closure is secured to the opening.

* * * * *